United States Patent [19]

Shigemori et al.

[11] 4,017,830

[45] Apr. 12, 1977

[54] SHEET COMPARING SYSTEM AND COMPARATOR ADAPTED FOR SAID SYSTEM

[75] Inventors: Hideto Shigemori; Motoaki Fukunaga, both of Himeji, Japan

[73] Assignee: Glory Kogyo Kabushiki Kaisha, Japan

[22] Filed: Feb. 13, 1975

[21] Appl. No.: 549,736

Related U.S. Application Data

[63] Continuation of Ser. No. 287,570, Sept. 8, 1972, abandoned.

[30] Foreign Application Priority Data

Sept. 9, 1971 Japan ..... 46-69956
Sept. 9, 1971 Japan ..... 46-69957

[52] U.S. Cl. ..... 340/146.2; 235/92 SB; 235/92 CA; 307/293

[51] Int. Cl.[2] ..... B07B 13/04

[58] Field of Search ..... 235/92 SB, 92 CA, 92 PB, 235/177, 92 EC; 307/232, 239, 293; 328/77, 94, 138, 165; 340/146.2

[56] References Cited

UNITED STATES PATENTS

| | | | |
|---|---|---|---|
| 3,075,189 | 1/1963 | Lisicky | 235/92 CA |
| 3,413,412 | 11/1968 | Townsend | 328/165 |
| 3,588,459 | 6/1971 | Dilger | 235/92 EC |
| 3,710,936 | 1/1973 | Mizunuma | 235/92 SB |
| 3,750,626 | 8/1973 | Smith | 235/92 CA |

*Primary Examiner*—Malcolm A. Morrison
*Assistant Examiner*—Errol A. Krass

[57] ABSTRACT

A sheet comparing system, in which comparison between a number of sheets to be counted and an actually counted number of the sheets is carried out so that noise signals other than the signals required to carry out the comparison are excluded. A simple comparator circuit adapted for the sheet comparing system is also disclosed.

2 Claims, 3 Drawing Figures

SHEET COMPARING SYSTEM AND COMPARATOR ADAPTED FOR SAID SYSTEM

This application is a continuation of Ser. No. 287,570, filed 09/08/72, and now abandoned.

BACKGROUND OF THE INVENTION

In conventional sheet counters for automatically counting a number of sheets such as bank notes, the structure of the comparator circuit included in the counter is relatively complex; furthermore conventional sheet counters suffer from the problem of time delay which is caused by the figure place shifting operation of a counter and by the operations of the elements composing the counter and a comparator, that is, the operations of the counter and the comparator with respect to a unit counting input become different in time, as a result noise signals are produced in addition to the necessary signals present in conventional sheet counters thereby causing erroneous operation thereof.

SUMMARY OF THE INVENTION

Therefore, an essential object of the present invention is to provide a sheet comparing system and a comparator circuit adapted for use in the system, which is able to perform correct sheet counting without the problems involved in conventional sheet counters as mentioned above.

The above-mentioned and other objects of the invention have been attained by adopting a system and comparator circuit, which system is characterised in that a predetermined number of sheets to be counted and a counting value counted by a counter provided in the sheet counter, are compared at a time which is delayed by a predetermined period of time from the leading edge of a counting signal adapted to drive the counter, and the comparator circuit is characterized in that the circuit comprises a comparator composed of exclusive OR gates each utilizing equality in the source side and the drain side of an MOS transistor, whereby a predetermined set number of sheets to be counted is compared with a counting value counted by a counter provided in the sheet counter.

The present invention will be described in detail in connection with the accompanying drawing.

DETAILED DESCRIPTION OF THE INVENTION

Figure 1:
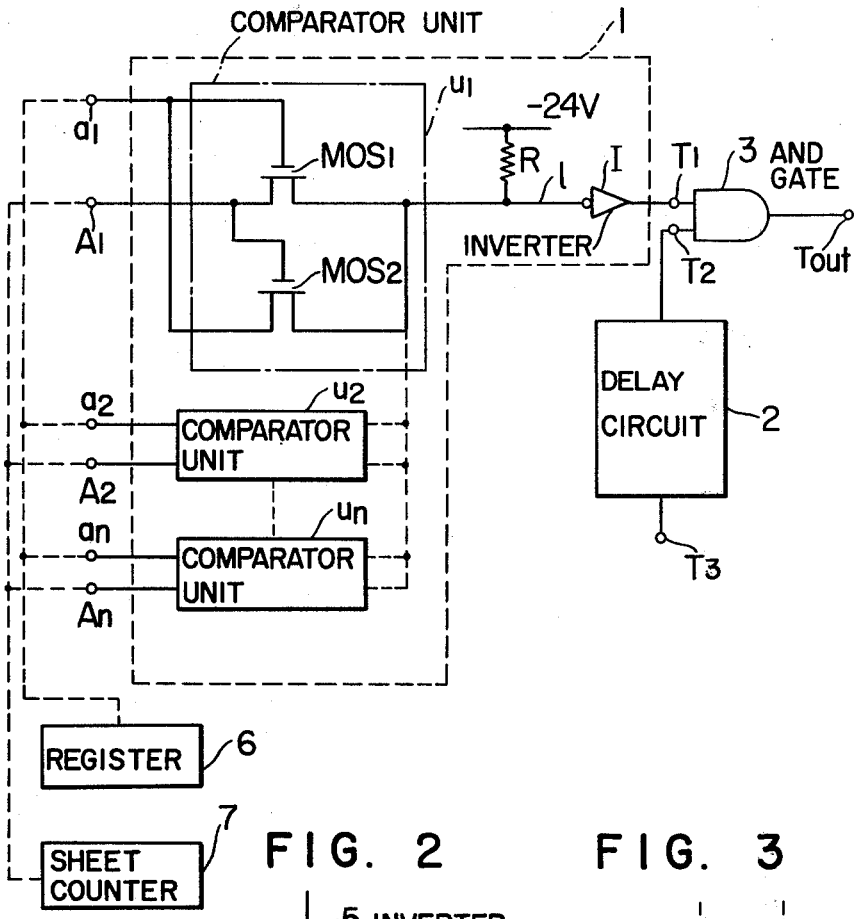
FIG. 1 is a block circuit diagram showing an embodiment of the present invention.
Figure 2:
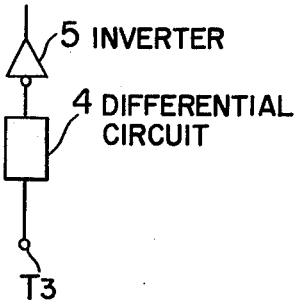
FIG. 2 is a block circuit diagram showing the delay circuit in the circuit shown in FIG. 1.

With reference now to FIGS. 1 and 2, one embodiment of the sheet comparing system according to the present invention is shown, which comprises a comparator 1, a delay circuit 2 and an AND gate 3, the delay circuit comprising a differential circuit 4 and an inverter 5 such as shown in FIG. 2. Binary unit bit signals are applied to a group of input terminals $a_1$, $a_2$ through $a_n$ of the comparator 1 from a conventional register 6. The register 6 stores the predetermined number of sheets to be counted. Another group of input terminals $A_1$, $A_2$ through $A_n$ of the comparator 1 are connected to a conventional sheet counter 7, and unit bit signals are therefore applied to the input terminals $A_1$, $A_2$ through $A_n$ from the counter, respectively. In this connection, each unit digit of the previously set value set in the register and the counted value of the counter is composed of four bits.

In the system shown in FIG. 1, various conventional types of comparator can be employed for the comparator 1. However, the comparator 1 itself shown in FIG. 1 comprises a plurality of comparator units each of which comprises bar type MOS transistors $MOS_1$ and $MOS_2$ so that comparison of the signals is carried out for every bit. A comparator unit $U_1$ serves to accomplish the comparison of the unit bit signal $a_1$ from the register and the unit bit signal $A_1$ from the counter. Only when both of the unit bit signals $a_1$ and $A_1$ coincide with each other in either a high level or a low level, a low level signal is produced at the output of the comparator unit $U_1$. Hereinafter, the high level will be represented by H while the low level will be represented by L. Furthermore, in the example described herein, H is DC zero volt, and L is DC −24 volt. The other comparator units function in the same manner as described above with reference to the comparator unit $U_1$. Thus, the comparison of unit digit information is carried out by four comparator units which are similar in construction. Therefore, in the comparator 1, when the input bit signals $a_1$ and $A_1$, or $a_2$ and $A_2$, or through $a_n$ and $A_n$ are all the same in either H level or L level, an output signal of L level is produced on a line $l$. The level of the output signal is converted through an inverter I into H level and is then applied to an input terminal $T_1$ which is one of the input terminals of the AND gate 3.

The functions of the MOS transistors $MOS_1$ and $MOS_2$ will be further described in detail with H and L being represented by 1 and 0, respectively. In the comparison unit $U_1$, when signals 1 and 0 are applied respectively to the terminals $a_1$ and $A_1$, the MOS transistor $MOS_1$ becomes non-conductive while the other MOS transistor $MOS_2$ becomes conductive, as a result of which a signal on the line $l$ will be 1. When a signal 0 is applied to the terminal $a_1$ and also a signal $O$ is applied to the terminal $A_1$, the MOS transistor $MOS_1$ becomes non-conductive while the MOS transistor $MOS_2$ also becomes non-conductive, as a result of which a signal produced on the line $l$ will be 0. When signals 0 and 1 are applied respectively to the terminals $a_1$ and $A_1$, the transistor $MOS_1$ becomes conductive while the transistor $MOS_2$ becomes non-conductive, as a result of which a signal 1 will be produced on the line $l$. Furthermore, when signals 1 and 1 are applied respectively to the terminals $a_1$ and $A_1$, both of the transistors $MOS_1$ and $MOS_2$ become non-conductive, as a result of which a signal produced on the line $l$ will be 0.

As is apparent from the above description, only when both of the signals applied to the terminals $a_1$ and $A_1$ are 0 or 1, a signal 0 is produced on the line $l$.

The functions of the other comparator units, which serve to perform the comparison of other bit signals, are the same as that of the comparator unit $U_1$ described above. However, only when the signals applied to the terminals $a_1$, $a_2$ through $a_n$ are all coincident in level with those applied to the terminals $A_1$, $A_2$ through $A_n$, respectively, a signal of 0 appears on the line $l$. If there is any comparator unit in which bit signals applied to its inputs are not coincident in level, an electrical current flows through a resistor R, as result of which a signal level produced on the line $l$ will be 1.

The signal 0 produced on the line $l$ is converted through the inverter I into a signal 1, and is then applied to the input terminal $T_1$ which is one of the input terminals of the AND gate 3. The production of the signal 1 at the terminal $T_1$ means that the contents in the register and those in the counter are completely coincident with each other. The signal thus produced can be used as a comparison coincidence signal, as it is. However, when the operating period of time in each of the counter and the comparator is taken into consideration, it is more effective to remove noise signals caused during the operations of the counter and comparator, by producing the comparison coincidence signal at a time-point which is delayed by a predetermined period of time from the rising time of a counting signal shown in FIG. 3, for instance at the decay time of the counting signal.

Figure 3:
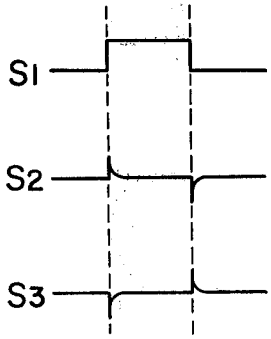
FIG. 3 shows wave forms at various points of the circuit shown in FIG. 2.

A counting signal such as a signal $S_1$ shown in FIG. 3 is applied to the input terminal $T_3$ of the delay circuit 2 where the counting signal is differentiated by the differential circuit 4 into a pulse signal such as a signal $S_2$ illustrated in FIG. 3. Then, the polarity of the pulse signal is inverted by the inverter 5 into a pulse signal such as a signal $S_3$ shown in FIG. 3. This signal $S_3$ is applied to the other terminal $T_2$ of the gate 3. It will be clearly understood from the above description that the positive pulse of the pulse signal $S_3$ is delayed from the rising of the counting signal.

Thus, only when signals 1 are aplied to the terminals $T_1$ and $T_2$ of the AND gate 3, a signal 1, namely, the comparison coincidence signal is produced at the output terminal of the AND gate 3. The above-described counting signal $S_1$ is a signal which is generated whenever one sheet is detected, and the counter is driven by the rising portion of the counting signal $S_1$. Therefore, each bit signal is applied to the comparator 1 through the operation of the counter thereby to operate the comparator 1. Upon completion of the operation of the comparator 1 a signal of 1 is applied to one input terminal $T_1$ of the AND gate 3. Accordingly, when a signal of 1 is produced at the terminal $T_1$ of the AND gate 3, a signal of 1, namely, a comparison coincidence signal is obtained at the output terminal T-out. Consequently, no noise signal caused during the operations of the counter and the comparator is delivered to the output side of the sheet counter.

Since the sheet comparing circuit according to the present invention is composed as described above, it can eliminate various, intricate circuits and circuit elements which have been employed in the comparison circuit of the conventional sheet counter, and furthermore can carry out the sheet comparing operation of high accuracy with the elements less in number than those of the conventional sheet counter.

In addition, in the present invention, the comparison coincidence signal is made to be obtained after the counter and the comparator have sufficiently operated, as a result of which the noise signals can be effectively removed.

We claim:

1. A sheet counter comparison system for automatically comparing a counted number of sheets with a predetermined number of sheets to be counted, which system comprises:

register means for storing information representative of said predetermined number of sheets to be counted;

counter means for counting a sequence of counting pulse signals representative of the sheets being counted by the counter, said counter means being driven step-by-step at the leading edge of each of said counting pulse signals;

comparator means connected to receive the outputs of said register means and said counter means for producing at the output thereof a comparison coincidence signal when the number represented by the output from said counter means equals said predetermined number of sheets to be counted; and gate control circuit means for producing an output coincidence signal in response to said comparison coincidence signal and to the trailing edge of said counting pulse signals, whereby said output coincidence signal is produced a predetermined time after the counting operation of said counter means.

2. A sheet counter comparison system for automatically comparing a counted number of sheets with a predetermined number of sheets to be counted, which system comprises:

register means for storing information representative of said predetermined number of sheets to be counted;

counter means for counting step-by-step in response to the leading edge of each counting pulse signal obtained when one of said sheets is counted;

comparison means for comparing the number of sheets counted by said counter means with said predetermined number of sheets stored in said register means; and comparison output control means for causing said comparison means to produce a comparison coincidence signal in response to the trailing edge of said counting pulse signal only when said number of sheets counted by said counter means coincides with said predetermined number of sheets stored in said register means, whereby said comparison coincidence signal will be produced a predetermined time after the step-by-step operation of said counter means to thereby eliminate noise signals which may be caused during the operation of said counter and comparator means.

* * * * *